US010434793B2

(12) United States Patent
Kondo et al.

(10) Patent No.: US 10,434,793 B2
(45) Date of Patent: Oct. 8, 2019

(54) PRINTING APPARATUS

(71) Applicant: Brother Kogyo Kabushiki Kaisha, Nagoya-shi, Aichi-ken (JP)

(72) Inventors: Tomohiro Kondo, Nagoya (JP); Yasuhiro Torii, Chiryu (JP); Kohei Terada, Kiyosu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/716,811

(22) Filed: Sep. 27, 2017

(65) Prior Publication Data

US 2018/0281454 A1 Oct. 4, 2018

(30) Foreign Application Priority Data

Mar. 30, 2017 (JP) ..... 2017-067072

(51) Int. Cl.

| | |
|---|---|
| ***B41J 2/365*** | (2006.01) |
| ***B41J 33/02*** | (2006.01) |
| ***B41J 2/325*** | (2006.01) |
| ***B41J 3/407*** | (2006.01) |

(52) U.S. Cl.

CPC ..... *B41J 2/365* (2013.01); *B41J 2/325* (2013.01); *B41J 3/4075* (2013.01); *B41J 33/02* (2013.01); *B41J 2202/31* (2013.01)

(58) Field of Classification Search

CPC ... B41J 2/365; B41J 2/325; B41J 33/02; B41J 2202/31

See application file for complete search history.

(56) References Cited

U.S. PATENT DOCUMENTS

2018/0207952 A1* 7/2018 Hattori ..... B41J 2/325

FOREIGN PATENT DOCUMENTS

| | | |
|---|---|---|
| JP | S62-053168 U | 4/1987 |
| JP | S63-098474 A | 4/1988 |
| JP | 2001-315374 A | 11/2001 |

OTHER PUBLICATIONS

Machine translation of JP 2001-315374 A. (JP 2001-315374 A was published on Nov. 13, 2001.) (Year: 2001).*

* cited by examiner

*Primary Examiner* — Justin Seo
(74) *Attorney, Agent, or Firm* — Banner & Witcoff, Ltd.

(57) ABSTRACT

A printing apparatus includes: a main body having a space therein, a thermal head arranged on a substrate provided in the space, the thermal head having heating elements arranged along a predetermined arrangement direction; a first conveyor which conveys an ink ribbon along a first conveyance path orthogonal to the arrangement direction, a second conveyor which conveys a printing object along a second conveyance path orthogonal to the arrangement direction and on an opposite side of the thermal head with respect to the first conveyance path, a first temperature sensor provided in a first space on a side of the thermal head with respect to the first conveyance path, a second temperature sensor provided in a second space between the first conveyance path and the second conveyance path, and a processor.

6 Claims, 4 Drawing Sheets

PRINTING APPARATUS

CROSS REFERENCE TO RELATED APPLICATION

The present application claims priority from Japanese Patent Application No. 2017-067072 filed on Mar. 30, 2017, the disclosure of which is incorporated herein by reference in its entirety.

BACKGROUND

Field of the Invention

The present invention relates to a printing apparatus.

Description of the Related Art

A printing apparatus in which an energy is applied to a heating element of a thermal head, and printing is carried out by imparting heat to a printing medium by the heating element that has generated heat has been known (For example, Japanese Patent Application Laid-open No. 2001-315374). In a printing apparatus of this type, in a case where an amount of energy (hereinafter, referred to as "applying energy") to be applied to the heating element is excessively small, there is a possibility that characters printed are faint and patchy. In a case where the amount of applying energy is excessively large, there is a possibility that the characters printed are blurred. In such manner, in a case where the amount of applying energy is inappropriate, there is a possibility that there arises a printing defect.

It has been known that when temperature of the thermal head and temperature of the printing medium which is heated by the heating element at the time of printing are identified, it is possible to correct with high accuracy the amount of applying energy. Practically, it is difficult to detect directly the temperature of the printing medium which is conveyed during printing. For example, in a thermal printer described in Japanese Patent Application Laid-open No. 2001-315374, a thermal head temperature sensor is provided for a thermal head. The thermal head temperature sensor detects the temperature of the thermal head. An ambient temperature sensor is provided for an interior of a main-body case. The ambient temperature sensor detects temperature of the interior of the main-body case instead of the temperature of the printing medium. The thermal printer corrects the amount of applying energy, based on the temperature of the thermal head and the temperature of the interior of the main-body case.

SUMMARY

In the thermal printer, since the ambient temperature sensor is provided on the side of the thermal head with respect to the printing medium, an effect of heat from the thermal head on the ambient temperature sensor is substantial. In this case, there arises deviation between change in the temperature detected by the ambient temperature sensor and change in the temperature of the printing medium, and there is a possibility that an accuracy of correcting the amount of applying energy is degraded.

An object of the present teaching is to provide a printing apparatus which is capable of correcting with high accuracy, the amount of energy to be applied.

According to an aspect of the present teaching, there is provided a printing apparatus, including: a main body having a space at an interior thereof; a thermal head arranged on a substrate provided in the space, the thermal head having heating elements arranged along a predetermined arrangement direction; a first conveyor configured to convey an ink ribbon along a first conveyance path, the first conveyance path being provided in the space and being orthogonal to the arrangement direction; a second conveyor configured to convey a printing object along a second conveyance path provided in the space, the second conveyance path being orthogonal to the arrangement direction and provided on a side opposite to the thermal head with respect to the first conveyance path; a first temperature sensor provided in a first space in the space, the first space being on a side of the thermal head with respect to the first conveyance path; a second temperature sensor provided in a second space in the space, the second space being interposed between the first conveyance path and the second conveyance path; and a processor configured to: correct an amount of applying energy to be applied to the heating elements, based on a first temperature detected by the first temperature sensor and a second temperature detected by the second temperature sensor; and apply corrected amount of the applying energy selectively to the heating elements to cause the heating elements to generate heat, and carry out printing by transferring an ink from the ink ribbon to the printing object with the heat generated.

In the printing apparatus according to an aspect of the present teaching, the amount of energy to be applied is corrected on the basis of the first temperature and the second temperature. Since the first temperature sensor is provided in the first space, on the side of the thermal head with respect to the first conveyance path, in the space at the interior of the main body, an effect of heat from the thermal head on the first temperature sensor becomes large. Consequently, a deviation between a change in the first temperature and a change in the temperature of the thermal head becomes small. Since the second temperature sensor is provided in the second space between the first conveyance path and the second conveyance path, in the space at the interior of the main body, an effect of heat from the thermal head on the second temperature sensor becomes small. Consequently, deviation between change in the second temperature and change in the temperature of the ink ribbon becomes small. Accordingly, the printing apparatus is capable of correcting the amount of applying energy with high accuracy.

DESCRIPTION OF THE EMBODIMENTS

An embodiment of the present teaching will be described below by referring to the accompanying diagrams. A printing apparatus 1 is connectable to an external terminal (omitted in the diagram) via a USB (universal serial bus) (registered trademark) cable. The printing apparatus 1 is capable of printing alphabets and characters such as figures (graphic characters) on a printing object via an ink ribbon 61, on the basis of print data received from the external terminal. The external terminal is a general purpose personal computer (PC). The printing object is a printing tape 91. The printing apparatus 1 can be driven by a battery. A left side, a right side, an upper side, a lower side, a front side of a paper surface, and rear side of a paper surface in FIG. 1 will be defined as a left side, a right side, a rear side, a front side, an upper side, and a lower side respectively, of the printing apparatus 1.

Figure 1:
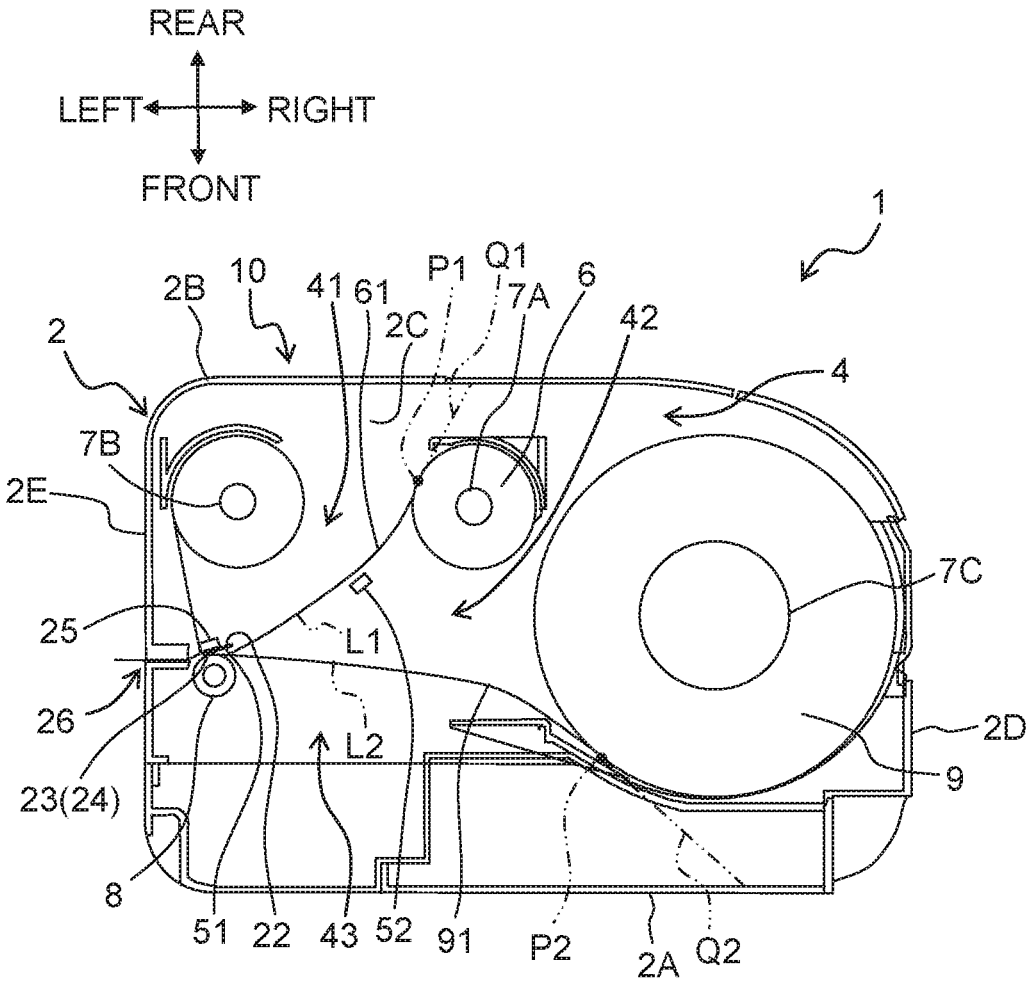
FIG. 1 is a cross-sectional view of a printing apparatus cut along a center in an up-down direction.

A mechanical arrangement of the printing apparatus 1 will be described below by referring to FIG. 1. The printing apparatus 1 includes a main body 10. The main body 10 is formed to be substantially rectangular-parallelepiped box-shaped, and has a space 4 at an interior thereof. More elaborately, the main body 10 includes a first cover 2 and a second cover (omitted in the diagram). The first cover 2 includes a front wall 2A, a rear wall 2B, a lower wall 2C, a right wall 2D, and a left wall 2E. Each of the front wall 2A, the rear wall 2B, the lower wall 2C, the right wall 2D, and the left wall 2E is in the form of a substantially rectangular-shaped plate.

The second cover is arranged at an upper side of the first cover 2 (frontward side of the paper surface in FIG. 1), and is openable and closable with respect to the first cover 2. When the second cover is in a state of being closed with respect to the first cover 2 (hereinafter, referred to as "closed state"), the second cover covers the first cover from an upper side, and demarcates the space 4. When the second cover is in a state of being opened with respect to the first cover 2 (hereinafter, referred to as "open state"), the space 4 is opened to an upper side (omitted in the diagram).

A discharge port (opening) 26 is provided to a substantially central portion in a frontward-rearward direction of the left wall 2E. The discharge port 26 discharges the printing tape 91 subjected to printing at an interior (the space 4) of the printing apparatus to the outside of the printing apparatus 1. A cutting blade (omitted in the diagram) is provided to the discharge port 26. The cutting blade is capable of cutting off a portion of the printing tape 91 on which the printing has been carried out.

The space 4 is provided with a ribbon supporting portion 7A, a ribbon take-up portion 7B, and a tape supporting portion 7C. The ribbon supporting portion 7A is provided at a rear side of a central portion in the frontward-rearward direction, in a substantially central portion in the left-right direction, of the main body 10. The ribbon supporting portion 7A is a shaft extended upward from the lower wall 2C. The ribbon supporting portion 7A rotatably supports a ribbon roll 6. The ribbon roll 6 is a supply source of the ink ribbon 61, and is formed by the ink ribbon 61 which is continuous, being wound around a tubular core. In the present embodiment, the ribbon roll 6 is wound in a counterclockwise direction in a plan view, from a trailing end of the ink ribbon 61 to the leading end (an end portion on an opposite side of the trailing end). The ribbon roll 6 is accommodated in the space 4, in a state of being supported by the ribbon supporting portion 7A.

The ribbon take-up portion 7B is provided to a left side of the ribbon supporting portion 7A. The ribbon take-up portion 7B is a shaft extended in the vertical direction, and is rotatably supported by the lower wall 2C. The used ink ribbon 61 is taken up by the ribbon take-up portion 7B.

The tape supporting portion 7C is provided to a right side of the ribbon supporting portion 7A, at a position inclined toward the front side. The tape supporting portion 7C is a shaft extended upward from the lower wall 2C. The tape supporting portion 7C rotatably supports a tape roll 9. The tape roll 9 is a supply source of the printing tape 91 which is continuous, and is formed by the printing tape 91 being wound around a tubular core. In the present embodiment, the tape roll 9 is wound in a clockwise direction in a plan view, from a trailing end of the printing tape 91 up to the leading end (an end portion on an opposite side of the trailing end). The printing tape 91 is accommodated in the space 4, in a state of being supported by the tape supporting portion 7C.

In the space 4, a platen roller 8 is provided near a right side of the discharge port 26. The platen roll 8 is extended in the vertical direction, and is rotatably supported by the lower wall 2C. An axis of rotation of the platen roll 8 is extended in the vertical direction.

In the space 4, a substrate 22 is provided near the right side of the discharge port 26, and on a rear side of the platen roller 8. A thermal head 23 is arranged near a left-end portion of a front surface of the substrate 22. The thermal head 23 is extended in the vertical direction. A length of the thermal head 23 in the vertical direction is substantially equal to the maximum width (length in the vertical direction) of the ribbon roll 6 (ink ribbon 61) that can be accommodated in the space 4. The thermal head 23 includes a plurality of heating elements arranged along the vertical direction. The heating elements 24 generate heat by an energy being applied thereto. A heat sink 25 is provided to a rear surface of the substrate 22. The heat sink 25 releases heat of the heating elements 24 that have generated heat. More elaborately, the heat of the heating elements 24 is transmitted to the heat sink 25 via the substrate 22. The heat sink 25 releases the heat transferred via the substrate 22, to an outside (outside air) of the printing apparatus 1.

In the arrangement described above, a user sets or removes the ribbon roll 6 and the tape roll 9 in the space 4, while keeping the second cover in the open state. In a state of the ribbon roll 6 and the tape roll 9 accommodated in the space 4, a direction of width of each of the ribbon roll 6 (ink ribbon 61) and the tape roll 9 (printing tape 91) is the vertical direction. When the second cover is in the closed state, the thermal head 23 and the platen roller 8 come mutually closer. In a case in which, the ink ribbon 61 and the printing tape 91 are arranged between the platen roller 8 and the thermal head 23, the platen roller 8 pushes (presses) the ink ribbon 61 and the printing tape 91 overlapping in the frontward-rearward direction, toward the thermal head 23. At this time, the ink ribbon 61 is arranged on a rear side of the printing tape 91 (side of the thermal head 23). The ribbon take-up portion 7B, with a drive of the conveyance motor 88 (refer to FIG. 2), takes up the used ink ribbon 61, and also draws out the unused ink ribbon 61 from the ribbon roll 6, and conveys the ink ribbon 61 that has been drawn out. The platen roller 8, with a drive of the conveyance motor 88 (refer to FIG. 2), draws out the printing tape 91 from the tape roll 9, and conveys the printing tape 91 drawn out, while pressing the ink ribbon 61 and the printing tape 91 against the thermal head 23. The thermal head 23 transfers an ink from the ink ribbon 61 to the printing tape 91 by the heating elements 24 generating the heat selectively, and prints characters in the units of lines on the printing tape 91.

In the following description, a point at which the ink ribbon 61 is drawn out from the ribbon roll 6 is defined as a "ribbon drawing point P". A point at which the printing tape 91 is drawn out from the tape roll 9 is defined as a "tape drawing point P2". A path along a direction of conveying the ink ribbon 61 conveyed by the ribbon take-up portion 7B is defined as a "ribbon conveyance path L". A path along a direction of conveying the printing tape 91 conveyed by the platen roller 8 is defined as a "tape conveyance path L2". In the present embodiment, the ribbon drawing point P1 is positioned on a left side of the ribbon roll 6. The tape drawing point P2 is positioned on a left side of the tape roll 9, at a position inclined toward the front side. Each of the ribbon conveyance path L1 and the tape conveyance path L2 is orthogonal to a direction in which the plurality of heating elements 24 is arranged (in other words, the vertical direction). The ribbon conveyance path L1, in a plan view, is extended to be inclined frontward and leftward from the ribbon drawing point P1 toward the thermal head 23, and is extended substantially rearward to be directed from the thermal head 23 toward the ribbon take-up portion 7B. The tape conveyance path L2, in a plan view, is extended to be slightly inclined leftward and rearward from the tape drawing point P2 toward the thermal head 23, and is extended leftward from the thermal head 23 toward the discharge port 26. The tape conveyance path L2 runs on an opposite side (in other words, the front side) of the thermal head 23, with respect to the ribbon conveyance path L1.

A side of the thermal head 23 (in other words, the rear side) with respect to the ribbon conveyance path L1, in the space 4 is defined as a "first space 41". A space between the ribbon conveyance path L1 and the tape conveyance path L2, in the space 4, is defined as a "second space 42". An opposite side of the ribbon conveyance path L1 with respect to the tape conveyance path L2, in the space 4, is defined as a "third space 43". With the ribbon conveyance path L1 extended in a reverse direction of the direction in which the ribbon conveyance path L1 is extended from the ribbon drawing point P1, a virtual plane in which the extended ribbon conveyance path L1 is extended in the direction of width of the ink ribbon 61 (vertical direction) is defined as a "first virtual plane Q1". With the tape conveyance path L2 extended in a reverse direction of the direction in which the tape conveyance path L2 is extended from the tape drawing point P2, a virtual plane in which the extended tape conveyance path L2 is extended in the direction of width of the printing tape 91 (vertical direction) is defined as a "second virtual plane Q2". The first space 41 and the second space 42 are demarcated by the first virtual plane Q1. The second space 42 and the third space 43 are demarcated by the second virtual plane Q2.

A first thermistor 51 is provided in the first space 41. In the present embodiment, the first thermistor 51 is provided at a central portion of a front surface of the substrate 22 (in other words, at a right side of the thermal head 23). The first thermistor 51 is a temperature sensor which is capable of detecting temperature. More elaborately, the first thermistor 51 detects a temperature of the substrate 22 and a temperature of the heat sink 25. In the present embodiment, the temperature of the substrate 22 and the temperature of the heat sink 25 are treated to be equal.

A second thermistor 52 is provided in the second space 42. In the present embodiment, the second thermistor 52 is provided to an upstream side of the ribbon conveyance path L1 and the tape conveyance path L2, of the plurality of heating elements 24 (printing position). In other words, the second thermistor 52 is provided at a right side of the virtual plane extended in the frontward-rearward direction, past the plurality of heating elements 24. More elaborately, the second thermistor 52 is provided near a front side of the ribbon conveyance path L1, at a central portion of a line segment connecting the platen roller 8 and the ribbon supporting portion 7A. The second thermistor 52 is provided at an inner side of the width of the ink ribbon 61 in the vertical direction, in a state of the ribbon roll 6 (ink ribbon 61) having the maximum width that can be accommodated in the space 4, being accommodated in the space 4. The second thermistor 52 is provided within the width of the thermal head 23, in the vertical direction. The second thermistor 52 is provided at a left side of a central portion in the left-right direction of the second space 42, and is provided at a position not facing the front surface of the substrate 22 in the frontward-rearward direction. The second thermistor 52 is a temperature sensor which is capable of detecting temperature.

Each of the ribbon supporting portion 7A and the tape supporting portion 7C is arranged in the second space 42. In other words, the ribbon roll 6 accommodated in the space 4, in a state of being supported by the ribbon supporting portion 7A, is arranged in the second space 42. The tape roll 9 accommodated in the space 4, in a state of being supported by the tape supporting portion 7C, is arranged in the second space 42.

Figure 2:
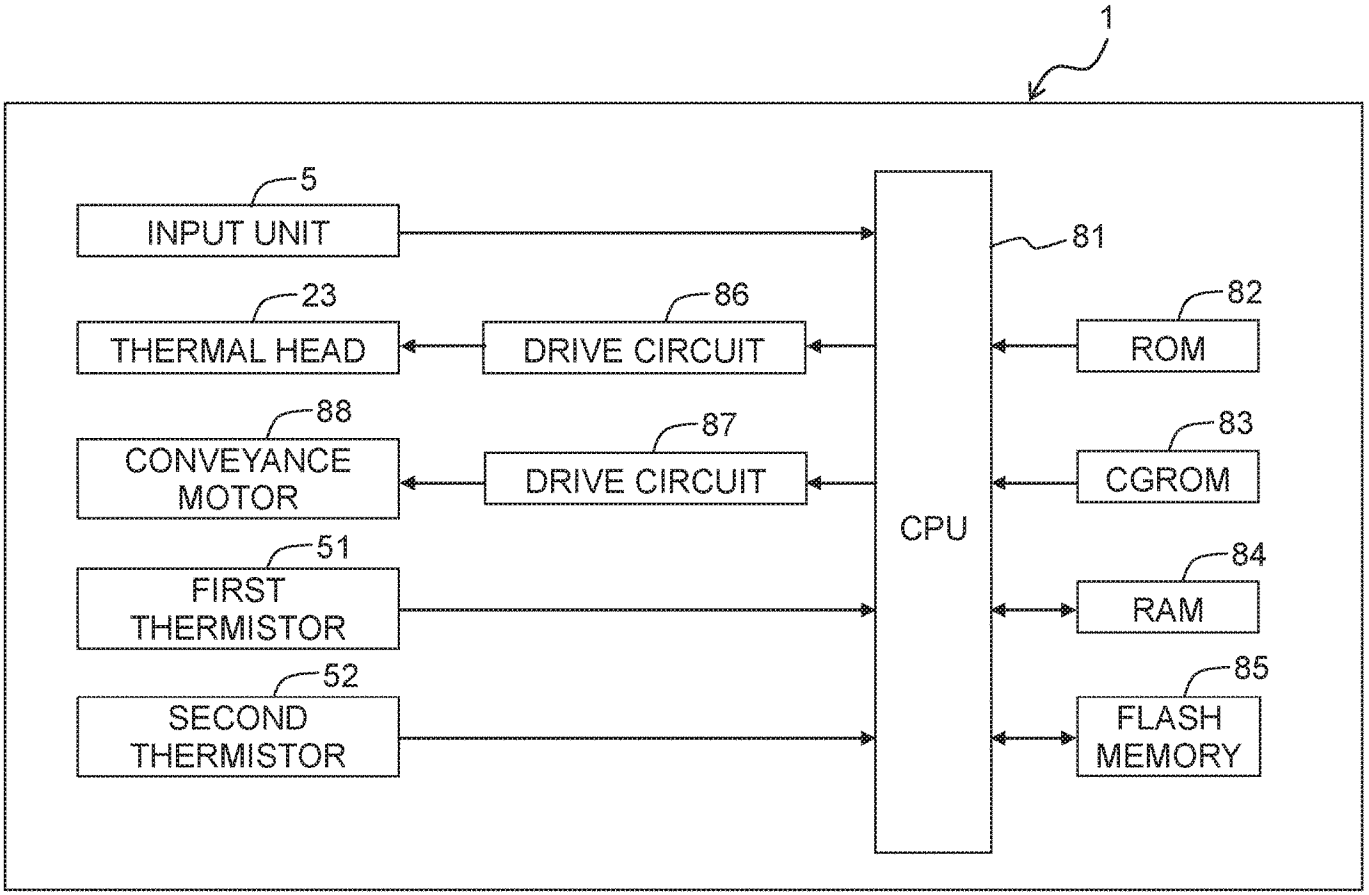
FIG. 2 is a block diagram depicting an electrical arrangement of the printing apparatus.

An electrical configuration of the printing apparatus 1 will be described below by referring to FIG. 2. The printing apparatus 1 includes a CPU (central processing unit) 81 which carries out an integrated control of the printing apparatus 1. The CPU 81 is connected to a ROM (read only memory) 82, a CGROM (character generator read only memory) 83, a RAM (random access memory) 84, a flash memory 85, the input unit 5, drive circuits 86 and 87, the first thermistor 51, and the second thermistor 52.

The ROM 82 stores various parameters that are necessary when the CPU 81 executes various computer programs. Print data for test printing for example (hereinafter, referred to as "test print data") and design parameters that will be described later are stored in the ROM 82. In the present embodiment, for identifying media parameters that will be described later, a test printing is carried out before carrying out normal printing. The test print data includes print data of a plurality of patterns that have been determined in advance for carrying out printing in which the media parameters can be identified. The CGROM 83 stores dot-pattern data for printing characters. The RAM 84 includes a plurality of storage area such as a text memory and print buffer. The flash memory 85 stores various computer programs which the CPU 81 executes for controlling the printing apparatus 1. Print data acquired from an external terminal for example is stored in the flash memory 85. The input section 5 includes switches to input various information to the printing apparatus 1, and a power-supply switch to start-up the printing apparatus 1 is included the switches. The drive circuit 86 is an electronic circuit for driving the thermal head 23. The drive circuit 87 is an electronic circuit for driving the conveyance motor 88.

In the present embodiment, the CPU 81, on the basis of the print data, applies energy selectively to the plurality of heating elements 24. The CPU 81 corrects an amount of the energy to be applied (hereinafter, referred to as "applying energy") to the plurality of heating elements 24. Accordingly, the printing apparatus 1 is capable of reducing a printing defect. In a case of correcting an amount of applying energy, information of temperature of the plurality of heating elements 24 and information of temperature of the ink ribbon 61 which is heated directly by the heating elements 24 are necessary. The printing apparatus of the present embodiment acquires the information necessary for correcting the applying energy as described below.

An equation of state that is established in a system including n number of elements (here, n is a natural number) will be described. Variables, vectors, and matrices to be used in the following description will be described below. In the following description, t is a variable and denotes time. Moreover, $T_k(t)$ is a vector which includes n real numbers, and is a function of t. Here, $T_k(t)$ denotes temperature of $k^{th}$ (k=1, 2, 3, . . . ) element. Moreover, $T_k(\mathbf{0})$ denotes an initial value of temperature. Furthermore, A is a matrix including real numbers of n rows and n columns, and indicates relationship of flow of heat for each element. More elaborately, A denotes a thermal capacity and a coefficient of heat transfer of each element, and indicates an amount of heat stored in each element, a heat transfer path to each element, and an amount of heat transferred to each element. B is a matrix including real numbers of n rows and m columns, and corrects the equation. Moreover, u(t) is a vector which includes m real numbers, and is a function of t. Furthermore, u(t) indicates an amount of energy that is inputted to the system. Moreover, $T_{airZ}$ denotes an ambient temperature outside the system, and is let to be constant.

When the energy u(t) is inputted to the system, there is transfer of heat between elements, and between each element and an atmosphere outside the system. In this case, expression (1) expressed by a simultaneous differential equation on the basis of modern control theory is established.

[Expression 1]

$$\frac{d}{dt}\begin{bmatrix} T_1(t) - T_{airZ} \\ \vdots \\ T_n(t) - T_{airZ} \end{bmatrix} = A\begin{bmatrix} T_1(0) - T_{airZ} \\ \vdots \\ T_n(0) - T_{airZ} \end{bmatrix} + Bu(t) \tag{1}$$

By solving expression (1), expression (2) is achieved.

[Expression 2]

$$\begin{bmatrix} T_1(t) - T_{airZ} \\ \vdots \\ T_n(t) - T_{airZ} \end{bmatrix} = e^{At}\begin{bmatrix} T_1(0) - T_{airZ} \\ \vdots \\ T_n(0) - T_{airZ} \end{bmatrix} + \int_0^t e^{A(t-\tau)}Bu(\tau)\,d\tau \tag{2}$$

In expression (2), A is assumed to be a known number. In other words, $e^{At}$ and a second item on the right-hand side, are assumed to be known values. In this case, the number of unknown values is 2n which includes n number of the initial temperatures ($T_k(\mathbf{0})$) of each element, and n number of the temperatures ($T_k(t)$) at the time t. Expression (2) being a simultaneous expression including n number of equations, when n number of unknown parameters are identified, all the unknown parameters are determined.

When one temperature sensor is arranged for one specific element, two unknown parameters, which are the initial temperature and the temperature at time t, are identified for one element. Therefore, when two temperature sensors are arranged for mutually different elements (positions), four unknown parameters are identified. In this case, when the remaining (n−4) number of unknown parameters are identified, all the unknown parameters are determined.

Expression (2) is applied to a system which includes the space 4 of the present embodiment. The system which includes the space 4 of the present embodiment includes five elements (in other words, n=5), for example. More specifically, the five elements are, the thermal head 23, the heat sink 25, an atmosphere of the first space 41, an atmosphere of the second space 42, and the ink ribbon 61. In this system, when the applying energy is applied to the heating elements 24, a part of the heat of the heating elements 24 flows to the heat sink 25 and the ink ribbon 61. The heat flowed to the ink ribbon 61 flows to an outside of the system. A part of the heat flowed to the heat sink 25 flows to the outside of the system, and to the first space 41. A part of the heat flowed to the first space 41 flows to the second space 42. In the expression to be used in the following description, the thermal head 23 is denoted by h, the heat sink 25 is denoted by hs, the atmosphere of the first space 41 is denoted by airA, the atmosphere of the second space 42 is denoted by airB, and the ink ribbon 61 (media) is denoted by m. For example, $T_h(\mathbf{0})$ denotes initial temperature of the thermal head 23. Moreover, $T_{airZ}$ denotes temperature of the atmosphere (ambient air) of the outside of the system, and is equal to the initial temperature of the atmosphere of the second space 42 for example. Furthermore, u(τ) denotes the applying energy at the time t=τ. In this case, expression (3) is established on the basis of expression (2).

[Expression 3]

$$\begin{bmatrix} T_h(t) - T_{airZ} \\ T_{hs}(t) - T_{airZ} \\ T_{airA}(t) - T_{airZ} \\ T_{airB}(t) - T_{airZ} \\ T_m(t) - T_{airZ} \end{bmatrix} = e^{At}\begin{bmatrix} T_h(0) - T_{airZ} \\ T_{hs}(0) - T_{airZ} \\ T_{airA}(0) - T_{airZ} \\ T_{airB}(0) - T_{airZ} \\ T_m(0) - T_{airZ} \end{bmatrix} + \int_0^t e^{A(t-\tau)}Bu(\tau)\,d\tau \tag{3}$$

In expression (3), A includes design parameters and media parameters. The design parameters are known values determined in advance by design items of the printing apparatus 1. The design parameters, for example, are a thermal capacity of each of the thermal head 23, the heat sink 25, the atmosphere of the first space 41, and the atmosphere of the second space 42, and a coefficient of heat transfer among the thermal head 23, the heat sink 25, the atmosphere of the first space 41, and the atmosphere of the second space 42 when there is a heat transfer therebetween. The coefficient of heat transfer as a design parameter includes a coefficient of heat transfer between the thermal head 23 and the heat sink 25, a coefficient of heat transfer between the heat sink 25 and the first space 41, and a coefficient of heat transfer between the heat sink 25 and the atmosphere of the outside of the system.

The media parameters are unknown values that depend on a type of the ink ribbon 61 (such as a material, a width, and a thickness of the ink ribbon 61). The media parameters include parameters such as a thermal capacity of the ink ribbon 61, a coefficient of heat transfer between the ink ribbon 61 and the thermal head 23, and a coefficient of heat transfer between the atmosphere of the first space 41 and the atmosphere of the second space 42 which are demarcated by the first virtual plane Q1. In the present embodiment, the media parameters are identified by the test printing. Accordingly, in expression (3), since A is identified, $e^{At}$ and a second item on a right-hand side of the expression, are known values that can be expressed in terms of t. Therefore, by the test printing, the initial temperature of each element and temperature at the time t of each element are the only unknown parameters in expression (3). Since expression (3) is a simultaneous equation including five equations, when the unknown parameters are not more than five, the printing apparatus is capable of computing all the parameters (the initial temperature and the temperature at the time t of all elements).

In the present embodiment, the printing apparatus 1 includes only two thermistors which are, the first thermistor 51 and the second thermistor 52, as temperature sensors to be used for correction of the applying energy. By arranging the first thermistor 51 and the second thermistor 52 at specific positions as mentioned above in the printing apparatus 1, it is possible to identify approximately the initial temperature of the ink ribbon 61, in addition to be able to identify the temperature (initial temperature and the temperature at the time t) of two elements. More specifically, from the temperature detected by the first thermistor 51 (hereinafter, referred to as "first temperature"), $T_{hs}(t)$ and $T_{hs}(0)$ are identified. From the temperature detected by the second thermistor 52 (hereinafter, referred to as "second temperature"), $T_m(0)$ is identified approximately in addition to $T_{airB}(t)$ and $T_{airB}(0)$ being identified. As mentioned above, $T_{airZ}$ is equal to $T_{airB}(0)$. Accordingly, the number of unknown parameters in expression (3) becomes five which are $T_h(t)$, $T_h(0)$, $T_{airA}(t)$, $T_{airA}(0)$, and $T_m(t)$. Hereinafter, the five unknown parameters will be collectively referred to as "parameters to be identified". The parameters to be identified, out of the unknown values independent of the type of the ink ribbon 61, are variables which cannot be identified only on the basis of the first temperature and also cannot be identified only on the basis of the second temperature. The number of parameters to be identified is five, and since expression (3) is a simultaneous equation including five equations, the printing apparatus 1 is capable of computing all the parameters on the basis of expression (3), by using the temperatures detected by the two thermistors (the first thermistor 51 and the second thermistor 52). Accordingly, the printing apparatus 1 is capable of correcting with high accuracy, the amount of applying energy, on the basis of the parameters computed, while suppressing an increase in the number of thermistors.

Figure 3A:
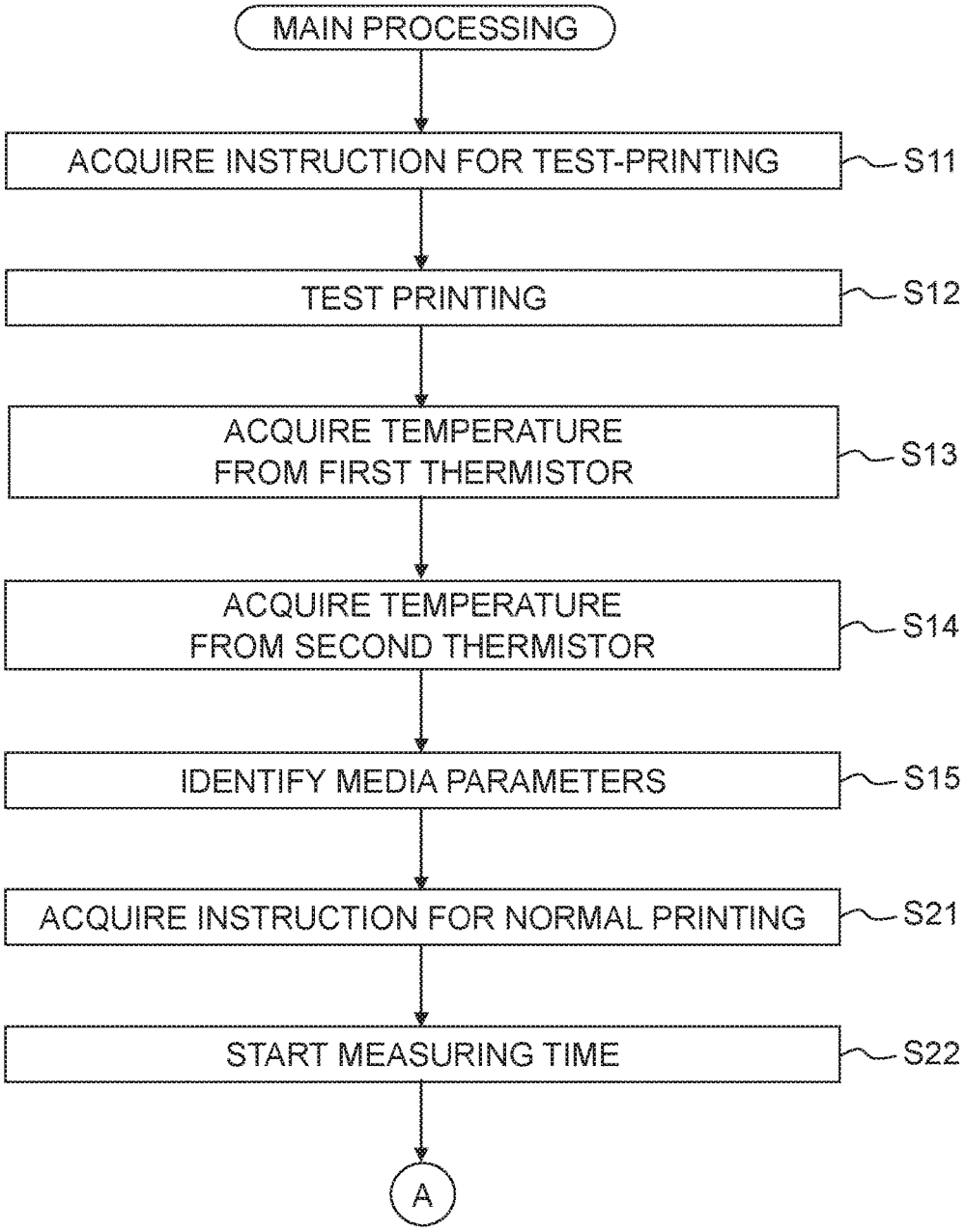
FIGS. 3A and 3B are a flowchart depicting a main processing.
Figure 3B:
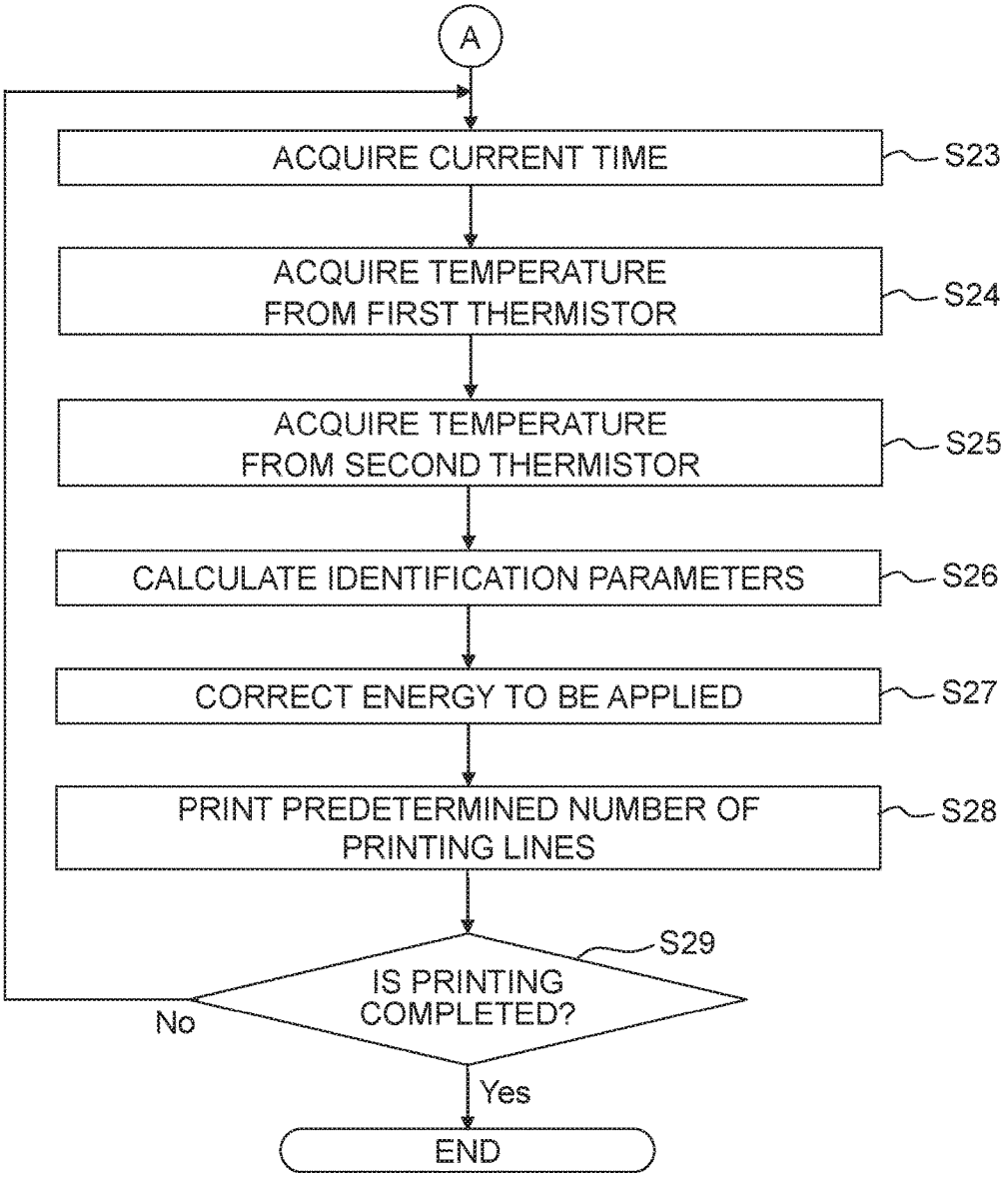

A main processing will be described below by referring to FIGS. 3A and 3B. A user operates a power-supply switch of the input unit 5, and starts-up the printing apparatus 1. When the printing apparatus 1 is started, the CPU 81 starts the main processing by executing a computer program stored in the ROM 82.

In the present embodiment, as mentioned above, the test printing is carried out prior to the normal printing. The user operates the input unit 5 and inputs an instruction for test printing to the CPU 81. The CPU 81 acquires the instruction for test printing inputted by the user (step S11). The CPU 81 reads out test printing data from the ROM 82, and executes the test printing on the basis of the test printing data (step S12). The CPU 81 acquires the first temperature from the first thermistor 51 (step S13). The CPU 81 acquires the second temperature from the second thermistor 52 (step S14). The CPU 81, on the basis of the first temperature and the second temperature acquired at steps S13 and S14, identifies the media parameters approximately (step S15). Accordingly, A in expression (3) is identified. Values of the media parameters identified approximately at step S15 are stored in the RAM 84. An accuracy of identifying the values of the media parameters may be improved by repeating step S12 to S14 for a plurality of times by the CPU 81.

As the test printing is completed, the user inputs an instruction for normal printing to the CPU 81 via the input unit 5. The CPU 81 acquires the instruction for normal printing inputted by the user (step S21). The instruction for normal printing includes the print data. The CPU 81 starts measuring time by a timer counter of the RAM 84 (step S22). The CPU 81 refers to the timer counter of the RAM 84, and acquires a current time (step S23). The current time is denoted by t in expression (3), and is 0 in the initial state (in other words, t=0). The current time acquired at step S23 is stored in the RAM 84.

The CPU 81 acquires the first temperature from the first thermistor 51 (step S24). The CPU 81 acquires the second temperature from the second thermistor 52 (step S25). The temperatures acquired at steps S24 and S25 are stored in the RAM 84. The CPU 81 compute the parameters to be identified on the basis of expression (3), by using the design parameters that have been stored in the ROM 82 in advance, the media parameters stored in the RAM 84 at step S15, the current time (t) stored in the RAM 84 at step S23, and the first temperature and the second temperature stored in the RAM 84 at steps S24 and S25 (step S26). Values of the parameters to be identified computed at step S26 are stored in the RAM 84.

The CPU 81 corrects the amount of the applying energy on the basis of $T_h$ and $T_m$ computed at step S26, by a known method (step S27). The amount of the applying energy that has been corrected at step S27 is stored in the RAM 84. The CPU 81 prints a predetermined number of printing lines on the basis of the applying energy corrected at step S27 (step S28). More elaborately, by controlling the conveyance motor 88, the printing tape 91 and the ink ribbon 61 are conveyed by a length equivalent to the predetermined number of printing lines. In synchronization with conveying the printing tape 91 and the ink ribbon 61 of the length equivalent to the predetermined number of printing lines, the amount of applying energy that has been corrected at step S27 is applied to the plurality of heating elements 24 for each printing line. At this time, the CPU 81, on the basis of the printing data, selectively applies the amount of applying energy that has been corrected, to the plurality of heating elements 24, and generates heat. Printing is carried out by transferring the ink of the ink ribbon 61 to the printing tape 91, by using the heat elements 24 that have generated heat. Consequently, the printing apparatus 1 is capable of reducing a printing defect due to the applying energy.

The CPU 81 determines whether the printing is to be terminated (step S29). In a case where data of printing lines, that have not been printed yet, has remained in the printing data, the CPU 81 determines not terminating the printing (NO at step S29). The CPU 81 returns the processing to step S23. In other words, the correction of the amount of applying energy (step S27) is carried out for printing of the predetermined number of printing lines every time. Therefore, the smaller the predetermined number (of printing lines), the more improved is the accuracy of correction of the amount of the applying energy. Moreover, the larger the predetermined number (of printing lines), the more lightened is the control load on the CPU 81. In a case where there is no data remained of the printing lines that have not been printed in the printing data, the CPU 81 determines that the printing is to be terminated (YES at step S29). The CPU 81 terminates the main processing.

As described heretofore, the amount of applying energy is corrected on the basis of the first temperature and the second temperature (step S27). It has been known that, as the temperature of the thermal head 23 and the temperature of the ink ribbon 61 to which the heat is imparted by the heating elements 24 at the time of printing are identified, it is possible to correct the amount of applying energy with high accuracy. The first thermistor 51 is provided in the first space 41 on the side of the thermal head 23 with respect to the ribbon conveyance path L1 in the space 4 at the interior of the main body 10. Therefore, an effect of the heat from the thermal head 23 on the first thermistor 51 is substantial. Consequently, deviation between change in the first temperature and change in the temperature of the thermal head 23 becomes small. At least a part of the heat that flows from the first space 41 to the second space 42 is blocked by the ink ribbon 61 which is in the ribbon conveyance path L1. Therefore, an effect of the heat from the thermal head 23 on the second space 42 is smaller than an effect of the heat from the thermal head 23 on the first space 41. The second thermistor 52 is provided in the second space 42 which is between the ribbon conveyance path L1 and the tape conveyance path L2, in the space 4 at the interior of the main body 10. Therefore, an effect of the heat from the thermal head 23 on the second thermistor 52 becomes small. Consequently, deviation between change in the second temperature and change in the temperature of the ink ribbon 61 becomes small. Therefore, the printing apparatus 1 is capable of correcting the amount of applying energy with high accuracy. Since the printing is carried out on the basis of the amount of applying energy that has been corrected, the printing apparatus 1 is capable of reducing a printing defect caused due to the applying energy.

Since the ribbon supporting portion 7A is provided in the second space 42, an effect of heat from the thermal head 23 on the ribbon roll 6 becomes smaller as compared to a case in which the ribbon supporting portion 7A is provided in the first space 41. Since deviation between the change in the second temperature and the change in the temperature of the ink ribbon 61 becomes small, the printing apparatus 1 is capable of correcting the amount of applying energy with high accuracy.

For instance, when the ink ribbon 61 is used for printing, there is an effect of heat from the thermal head 23. In the printing apparatus 1, since the second thermistor 52 is provided at a position where the unused ink ribbon 61 is accommodated, in the second space 42, deviation between the change in the second temperature and change in the temperature of the unused ink ribbon 61 becomes small. Consequently, the printing apparatus 1 is capable of correcting the amount of applying energy with high accuracy.

The second thermistor 52 is provided within the width of the thermal head 23, in the up-down direction. Since at least a part of radiant heat released from the heating elements 24 is blocked by the ink ribbon 61 in the ribbon conveyance path L1, an effect of heat from the thermal head 23 on the second thermistor 52 becomes small. Consequently, the deviation between the change in the second temperature and the change in the temperature of the ink ribbon 61 becomes small. As a result, the printing apparatus 1 is capable of correcting the amount of applying energy with high accuracy.

Since the first thermistor 51 is provided on the substrate 22, it is possible to detect the temperature of the substrate 22 with high accuracy. Since the thermal head 23 is arranged on the substrate 22, deviation between the change in the first temperature and the change in the temperature of the thermal head 23 becomes small. Consequently, the printing apparatus 1 is capable of correcting the amount of applying energy with high accuracy.

As the printing is carried out for instance, an amount of the unused ink ribbon 61 decreases (in other words, a diameter of the ribbon roll 6 becomes small) and an amount of the printing tape 91 decreases (in other words, a diameter of the tape roll 9 becomes small). Accordingly, a ratio of a proportion of air occupying the space 4 and a proportion of the unused ink ribbon 61 occupying the space 4, changes. Even in this case, since the printing apparatus 1 executes step S23 to S27 for each printing of the predetermined number of printing lines, it is possible to show the effect described above.

In the present embodiment, the up-down direction of the printing apparatus 1 corresponds to the "arrangement direction" of the present teaching. The ribbon conveyance path L1 corresponds to the "first conveyance path" of the present teaching. The ribbon take-up portion 7B corresponds to the "first conveyor". The tape conveyance path L2 corresponds to the "second conveyance path" of the present teaching. The platen roller 8 corresponds to the "second conveyor" of the present teaching. The first thermistor 51 corresponds to the "first temperature sensor" of the present teaching. The second thermistor 52 corresponds to the "second temperature sensor" of the present teaching. The ribbon roll 6 corresponds to the "roll" of the present teaching. The ribbon supporting portion 7A corresponds to the "first supporting portion" of the present teaching. The tape roll 9 corresponds to the "supply source" of the present teaching. The tape supporting portion 7C corresponds to the "second supporting portion" of the present teaching.

It is possible to make various modifications in the embodiment of the present teaching. For instance, in the embodiment, expression (2) was applied taking into consideration the five elements which are, the thermal head 23, the heat sink 25, the atmosphere of the first space 41, the atmosphere of the second space 42, and the ink ribbon 61, as the n number of elements. However, without restricting to five, the number of elements may be six or more than six. For instance, in a case where one element is added to the five elements in the embodiment, expression (4) is established on the basis of expression (2). The element added is denoted by add1.

[Expression 4]

$$\begin{bmatrix} T_h(t) - T_{airZ} \\ T_{hs}(t) - T_{airZ} \\ T_{airA}(t) - T_{airZ} \\ T_{airB}(t) - T_{airZ} \\ T_m(t) - T_{airZ} \\ T_{add1}(t) - T_{airZ} \end{bmatrix} = e^{At} \begin{bmatrix} T_h(0) - T_{airZ} \\ T_{hs}(0) - T_{airZ} \\ T_{airA}(0) - T_{airZ} \\ T_{airB}(0) - T_{airZ} \\ T_m(0) - T_{airZ} \\ T_{add1}(0) - T_{airZ} \end{bmatrix} + \int_0^t e^{A(t-\tau)} Bu(\tau)\, d\tau \tag{4}$$

In expression (4), $T_{hs}(t)$ and $T_{hs}(\mathbf{0})$ are identified from the first temperature. Moreover, $T_m(\mathbf{0})$ is approximately identified in addition to $T_{airB}(t)$ and $T_{airB}(\mathbf{0})$ being identified from the second temperature. In other words, since five parameters are identified, the number of unknown parameters is seven. Expression (4) being a simultaneous expression including six expressions, when one more unknown parameter can be identified, the printing apparatus 1 is capable of computing all the parameters. Consequently, when one of the first thermistor 51 and the second thermistor 52 is provided at a position where it is possible to identify $T_{hs}(t)$, $T_{hs}(\mathbf{0})$, $T_{airB}(t)$, $T_{airB}(\mathbf{0})$, and $T_m(\mathbf{0})$, and where at least one of $T_{add1}(t)$ and $T_{add1}(\mathbf{0})$ can be identified approximately from either the first temperature or the second temperature, the printing apparatus 1 is capable of computing all the parameters.

More specifically, adding the printing tape 91 to which the heating elements 24 impart heat via the ink ribbon 61, as an element, may be taken into consideration. In this case, the printing apparatus 1 may identify approximately an initial temperature of the printing tape 91 from the second temperature. Accordingly, the number of unknown parameters becomes six. Since expression (4) is a simultaneous equation including six equations, the printing apparatus 1 is capable of calculating all the parameters on the basis of expression (4) by using the temperatures detected by the two thermistors (the first thermistor 51 and the second thermistor 52). Accordingly, the printing apparatus 1 is capable of correcting the amount of applying energy with high accuracy based on the parameters calculated, without letting the number of thermistors to increase.

For instance, the tape roll 9 may be wound in a counter-clockwise direction in a plan view, from a trailing end up to a leading end of the printing tape 91. In other words, the tape supporting portion 7C which is provided in the second space 42 in the present embodiment may be provided in the third space 43. However, since a distance between the second thermistor 52 and the tape roll 9 becomes closer when the tape supporting portion 7C is provided in the second space 42, as compared to a case in which the tape supporting portion 7C is provided in the third space 43, an accuracy of approximating (of identifying approximately) the initial temperature of the printing tape 91 from the second temperature is improved. Since the tape supporting portion 7C is provided in the second space 42, an effect of heat on the tape roll 9 from the thermal head 23 becomes smaller as compared to a case in which the tape supporting portion 7C is provided in the first space 41. When the tape supporting portion 7C is provided in the second space 42, since deviation between the change in the second temperature and change in the temperature of the printing tape 91 becomes small, the printing apparatus 1 is capable of correcting the amount of applying energy with high accuracy. Without restricting the number of thermistors to two, a third thermistor may be provided to an additional element for instance, of the printing apparatus 1.

In the embodiment, the CPU 81 identifies the media parameters on the basis of the first temperature and the second temperature, by test printing. However, the method of identifying the media parameters is not restricted to the abovementioned method. For instance, a table in which the types of the ink ribbon 61 and the media parameters are associated may be stored in the ROM 82. In this case, the CPU 81 may acquire the type of the ink ribbon 61 at least before processing at step S25. The CPU 81 may acquire the type of the ink ribbon 61 which the user has input by operating the input section 5. The ribbon roll 6 may include an identification portion (such as an IC tag) which enables to identify the type of the ink ribbon 61. The printing apparatus 1 may include a reading section. The type of the ink ribbon 61 may be acquired by the CPU 81 reading out the identification portion of the ribbon roll 6 via the reading section when the ribbon roll 6 has been accommodated in the space 4. The CPU 81 may acquire, from the table, the media parameters corresponding to the type of the ink ribbon 61 acquired. In this case, it is possible for the printing apparatus 1 to omit the processing at steps S11 to S15, and to save the trouble of test printing.

A position at which the first thermistor 51 is to be provided is not restricted to the substrate 22. The first thermistor 51 may be provided for the heat sink 25 for example, or may be provided for the thermal head 23, or may be provided for another member in the first space 41. The closer the position at which the first thermistor 51 is provided to the thermal head 23, the higher is the accuracy of computing the temperature of the thermal head 23 at step S26 by the CPU 81.

A position at which the second thermistor 52 is to be provided is not restricted to the position in the embodiment. The second thermistor 52 may be provided to the ribbon supporting portion 7A for example, or may be provided to the platen roller 8, or may be provided to another member in the second space 42. The second thermistor 52 may be provided outside the width of the ink ribbon 61 in the vertical direction, or may be provided to a downstream side of the ribbon conveyance path L1, of the plurality of heating elements 24. The farther the position at which the second thermistor 52 is provided, from thermal had 23, and the nearer the position at which the second thermistor 52 is provided to the thermal had 23, the higher is the accuracy of identifying approximately the temperature of the ink ribbon 61 by the printing apparatus 1.

In the printing apparatus 1, another temperature sensor (such as a thermocouple) may be used instead of the first thermistor 51 and the second thermistor 52. In the embodiment, the tape roll 9 is the supply source of the printing object (printing tape 91). However, the supply source of the printing object may be a so-called fanfold paper in which the printing paper which is continuous is folded alternately. In this case, the printing apparatus 1 may include a supporting base which supports the fanfold paper from a lower side, instead of the tape supporting portion 7C. In FIG. 1, the ribbon roll 6 may be wound in the clockwise direction in a plan view, from the trailing end up to the leading end of the ink ribbon 61. In other words, the ribbon supporting portion 7A is provided in the second space 42 in the present embodiment, but the ribbon supporting portion 7A may be provided in the first space 41.

In the present embodiment, the classification of the design parameters and the media parameters is merely an example. In the printing apparatus 1, some or all of the media parameters may be stored in advance in the ROM 82, as known values. Some or all of the design parameters may be treated as unknown values, and the design parameters may be identified by the test printing for example.

Instead of the CPU 81, a microcomputer, an ASIC (application specific integrated circuit), an FPGA (field programmable gate array) etc. may be used as a processor. The main processing may be distributed to a plurality of processors. The flash memory 85 may not include a transitory storage medium (such as a signal to be transmitted). The computer program may be downloaded from a server connected to the network (in other words, transmitted as a transmission signal), or may be stored in the flash memory 85. In this case, it is preferable that the computer program is saved in a non-transitory storage medium such as an HDD (hard disc drive) in a server.

What is claimed is:

1. A printing apparatus, comprising:

a main body having a space at an interior thereof;

a thermal head arranged on a substrate provided in the space, the thermal head having heating elements arranged along a predetermined arrangement direction;

a first conveyor configured to convey an ink ribbon along a first conveyance path, the first conveyance path being provided in the space and being orthogonal to the arrangement direction;

a second conveyor configured to convey a printing object along a second conveyance path provided in the space, the second conveyance path being orthogonal to the arrangement direction and provided on a side opposite to the thermal head with respect to the first conveyance path;

a first temperature sensor provided in a first space in the space, the first space being on a side of the thermal head with respect to the first conveyance path;

a second temperature sensor provided in a second space in the space, the second space being interposed between the first conveyance path and the second conveyance path;

a first support portion provided between the first conveyance path and the second conveyance path and configured to support a roll on which unused ink ribbon has been wound; and a processor configured to:

correct an amount of applying energy to be applied to the heating elements, based on a first temperature detected by the first temperature sensor and a second temperature detected by the second temperature sensor; and apply corrected amount of the applying energy selectively to the heating elements to cause the heating elements to generate heat, and carry out printing by transferring an ink from the ink ribbon to the printing object with the heat generated.

2. The printing apparatus according to claim 1, wherein the second temperature sensor is provided on an upstream side of the heating elements in the first conveyance path and the second conveyance path.

3. The printing apparatus according to claim 1, wherein the second temperature sensor is provided within a width of the thermal head, with respect to the arrangement direction.

4. The printing apparatus according to claim 1, further comprising a heat sink provided on the substrate and configured to release the heat of the heating elements, wherein the first temperature sensor is provided on one of the substrate and the heat sink.

5. The printing apparatus according to claim 1, further comprising a second supporting portion provided in the second space and configured to support a supply source of the printing object that is continuous.

6. The printing apparatus according to claim 1, wherein the unused ink ribbon has a first surface which contacts with the printing object during the printing and a second surface opposite to the first surface, and the unused ink ribbon is wound on the roll such that the first surface faces the first supporting portion.

* * * * *